US009435176B2

(12) United States Patent
Bansal et al.

(10) Patent No.: US 9,435,176 B2
(45) Date of Patent: Sep. 6, 2016

(54) DEBURRING MILL TOOL FOR WELLBORE CLEANING

(71) Applicant: Weatherford Technology Holdings, LLC, Houston, TX (US)

(72) Inventors: Ram K. Bansal, Houston, TX (US); Arthur Warren Meeks, Porter, TX (US); Mohammed Aleemul Haq, Houston, TX (US); Bin Xiao, Houston, TX (US); Miroslav Mihalj, Houston, TX (US); David Peter Kippie, Abilene, TX (US); Thomas F. Bailey, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 247 days.

(21) Appl. No.: 13/662,120

(22) Filed: Oct. 26, 2012

(65) Prior Publication Data

US 2014/0116712 A1 May 1, 2014

(51) Int. Cl.

| | |
|---|---|
| ***E21B 37/02*** | (2006.01) |
| ***E21B 37/00*** | (2006.01) |
| ***E21B 10/32*** | (2006.01) |
| ***E21B 23/04*** | (2006.01) |
| ***E21B 29/00*** | (2006.01) |

(52) U.S. Cl.

CPC ..... *E21B 37/00* (2013.01); *E21B 10/32* (2013.01); *E21B 10/322* (2013.01); *E21B 10/325* (2013.01); *E21B 23/04* (2013.01); *E21B 29/005* (2013.01); *E21B 37/02* (2013.01)

(58) Field of Classification Search

USPC ..... 166/311, 170, 153

See application file for complete search history.

(56) References Cited

U.S. PATENT DOCUMENTS

| | | | | |
|---|---|---|---|---|
| 2,857,141 | A | | 10/1958 | Carpenter |
| 4,479,538 | A | | 10/1984 | Coyle, Sr. |
| 4,693,316 | A | * | 9/1987 | Ringgenberg et al. ..... 166/355 |
| 5,253,714 | A | | 10/1993 | Davis et al. |
| 5,351,758 | A | * | 10/1994 | Henderson et al. ..... 166/277 |
| 5,819,353 | A | | 10/1998 | Armell et al. |
| 5,829,521 | A | | 11/1998 | Brown, Jr. |
| 5,947,203 | A | | 9/1999 | Brown, Jr. |
| 6,152,221 | A | | 11/2000 | Carmichael et al. |
| 6,209,647 | B1 | | 4/2001 | Brown, Jr. |
| 6,227,291 | B1 | | 5/2001 | Carmichael et al. |
| 6,343,648 | B1 | | 2/2002 | Carmichael et al. |
| 6,347,667 | B1 | | 2/2002 | Howlett et al. |

(Continued)

FOREIGN PATENT DOCUMENTS

WO 2011/041562 A2 4/2011

OTHER PUBLICATIONS

Australian Patent Examination Report dated Mar. 13, 2015, for Australian Application No. 2013245515.

(Continued)

*Primary Examiner* — Taras P Bemko

(74) *Attorney, Agent, or Firm* — Patterson & Sheridan, LLP

(57) ABSTRACT

A wellbore cleaning tool for removing irregularities along the inner surface of a wellbore tubular may include a top sub, a cutting assembly, and a bottom sub. The tool is operable to remove irregularities, such as debris, burrs, and jagged edges, along the inside of the wellbore tubular, and thereby provide a clean, inner surface finish. The tool may be actuated into a retracted position, an extended position, and/or a deactivated position.

34 Claims, 13 Drawing Sheets

(56) References Cited

U.S. PATENT DOCUMENTS

| | | | | |
|---|---|---|---|---|
| 6,464,010 | B1 | 10/2002 | Brown | |
| 6,484,802 | B1 | 11/2002 | McGarian et al. | |
| 6,546,581 | B1 | 4/2003 | Swietlik et al. | |
| 6,851,472 | B2 | 2/2005 | Hern et al. | |
| 6,883,605 | B2 | 4/2005 | Arceneaux et al. | |
| 7,028,769 | B2 | 4/2006 | Mullins | |
| 7,121,343 | B2 | 10/2006 | Telfer | |
| 7,191,835 | B2 | 3/2007 | Howlett et al. | |
| 7,311,141 | B2 | 12/2007 | Tulloch et al. | |
| 7,435,373 | B2 | 10/2008 | Claerhout | |
| 7,559,374 | B2 | 7/2009 | Telfer | |
| 8,141,627 | B2 | 3/2012 | Krieg et al. | |
| 8,141,628 | B2 | 3/2012 | Hart | |
| 8,376,043 | B2 | 2/2013 | Knobloch et al. | |
| 8,408,307 | B2 | 4/2013 | Telfer | |
| 8,714,260 | B2 | 5/2014 | Knobloch et al. | |
| 8,826,986 | B2 | 9/2014 | Wolf | |
| 8,844,622 | B2 | 9/2014 | Telfer | |
| 8,905,126 | B2 | 12/2014 | Krieg et al. | |
| 2007/0089912 | A1* | 4/2007 | Eddison et al. | 175/269 |
| 2010/0089583 | A1 | 4/2010 | Xu et al. | |
| 2010/0181064 | A1 | 7/2010 | Knobloch et al. | |
| 2010/0186962 | A1 | 7/2010 | Knobloch et al. | |
| 2011/0214873 | A1* | 9/2011 | Krieg et al. | 166/311 |

OTHER PUBLICATIONS

Canadian Office Action dated Jul. 9, 2015, for Canadian Application No. 2,830,233.

Australian Patent Examination Report for Application No. 2013245515 dated Oct. 14, 2015.

Extended European Search Report dated Oct. 2, 2015, for Application No. EP13189644.1.

* cited by examiner

DEBURRING MILL TOOL FOR WELLBORE CLEANING

BACKGROUND OF THE INVENTION

1. Field of the Invention

Embodiments of the invention generally relate to a wellbore cleaning tool.

2. Description of the Related Art

In hydrocarbon recovery operations in subterranean wells, it is often necessary or desirable to remove debris or other irregularities along the inner surfaces of the well. For example, after a casing (or other wellbore tubular) is perforated, it is typically desirable to remove burrs, jagged edges, and/or other irregularities inside the casing prior to the installation of completion equipment. Debris or burrs on the inside of the casing may obstruct insertion and/or removal of other tools. Such irregularities may also damage other tools or tool components during run-in. For example, an elastomeric packer may be cut by a burr or jagged edge when lowered into the well through the casing, which may prevent the packer from sealing properly upon operation.

Current tools for removing debris or burrs are generally inflexible during operation and have many drawbacks. Some tools may be unable to provide full coverage of the inner diameter of the wellbore tubular, and may not accommodate horizontal or deviated well orientations. Other tools may be ineffective at transmitting rotational torque to the tool body to remove debris or burrs from the wellbore tubular. Finally, other tools may not be fully retractable beyond the outer diameter of the tool body when deactivated, thereby preventing the tool from being used in smaller diameter wellbore tubulars.

Based on the foregoing, there exists a need for new and improved tools and techniques for removing debris, burrs, and/or other irregularities formed along the inner surfaces of wellbore tubulars.

SUMMARY OF THE INVENTION

Embodiments of the invention include a wellbore tool that comprises a top sub; a cutting assembly that comprises a mandrel in fluid communication with the top sub; a piston disposed external to the mandrel; and a cutting member selectively movable into at least one of a retracted position, an extended position, and a deactivated position using the piston; and a bottom sub operable to close fluid flow through the tool.

Embodiments of the invention include a method of operating a wellbore tool that comprises lowering the tool into a tubular using a work string; rotating a cutting assembly of the tool to remove irregularities from an inner surface of the tubular, wherein the cutting assembly includes a mandrel, a piston, and a cutting member; and actuating the cutting member into at least one of a retracted position, an extended position, and a deactivated position using the piston, wherein the piston is disposed external to the mandrel.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the invention comprise a wellbore tool for cleaning the inner surfaces of wellbore tubulars. The wellbore tool may include a (360 degree circumferential) cutting mill operable to mill out and remove burrs from protruding inside a casing that are formed during a perforation job. The wellbore tool may be operable to create a smooth, clean casing inner diameter for running completion tools. Although described herein as a milling tool to remove burrs, embodiments of the invention are applicable to removing debris, burrs, jagged edges, and/or other irregularities formed along the inner surface of any wellbore tubulars.

Figure 1:
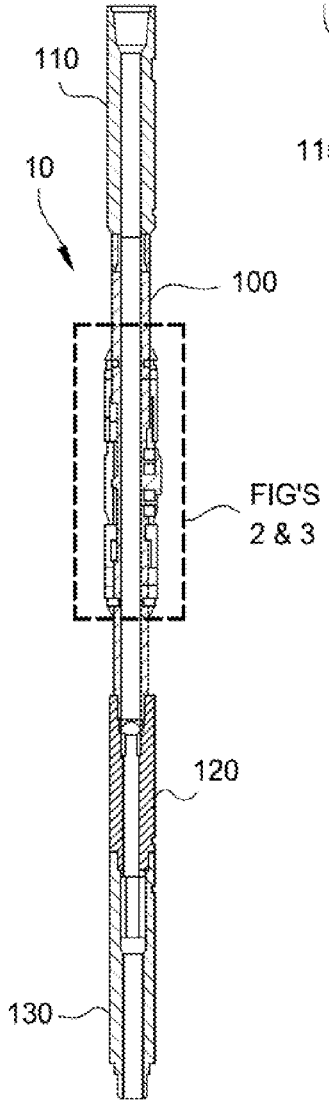
FIG. 1 illustrates a sectional view of a wellbore tool according to one embodiment.

FIG. 1 illustrates a sectional view of a wellbore tool 10 according to one embodiment. The wellbore tool 10 may include a top sub 110, a cutting assembly 100, an intermediate sub 120, and a bottom sub 130. The top sub 110 may include a cylindrical mandrel having a flow bore for fluid communication with the cutting assembly 100. The top sub 110 may be coupled at its upper end to a work string for running the tool 10 into and out of a well, and may be coupled at its lower end to the cutting assembly 100. In one embodiment, the intermediate sub 120 and the bottom sub 130 may be formed as a single, integral bottom sub member for coupling to the cutting assembly 100.

The cutting assembly 100, the intermediate sub 120, and the bottom sub 130 may each include cylindrical mandrels coupled together and having flow bores in fluid communication with each other to establish fluid flow through the entire tool 10. The intermediate sub 120 and/or the bottom sub 130 may be operable to selectively open and close fluid flow through the tool 10. In one embodiment, the intermediate sub 120 may include a seat (such as seat 595 illustrated in FIG. 20B) for receiving a closure member (such as closure member 590 illustrated in FIG. 20B) to close fluid flow through the end of the tool 10 for pressurization and actuation of the cutting assembly 100. The closure member may include an extrudable ball or dart as known in the art. The closure member may be removed, such as extruded, from the seat and directed to a closure member housing, such as a ball or dart catcher as known in the art to reestablish fluid circulation through the tool 10. The top sub 110, the cutting assembly 100, the intermediate sub 120, and the bottom sub 130 may be threadedly coupled and sealed together, and may be secured with anti-rotation screws to prevent inadvertent uncoupling of the tool 10 during operation. One or more seals, such as o-rings, may be used to seal fluid flow through one or more components of the tool 10 as known in the art.

Figure 2:
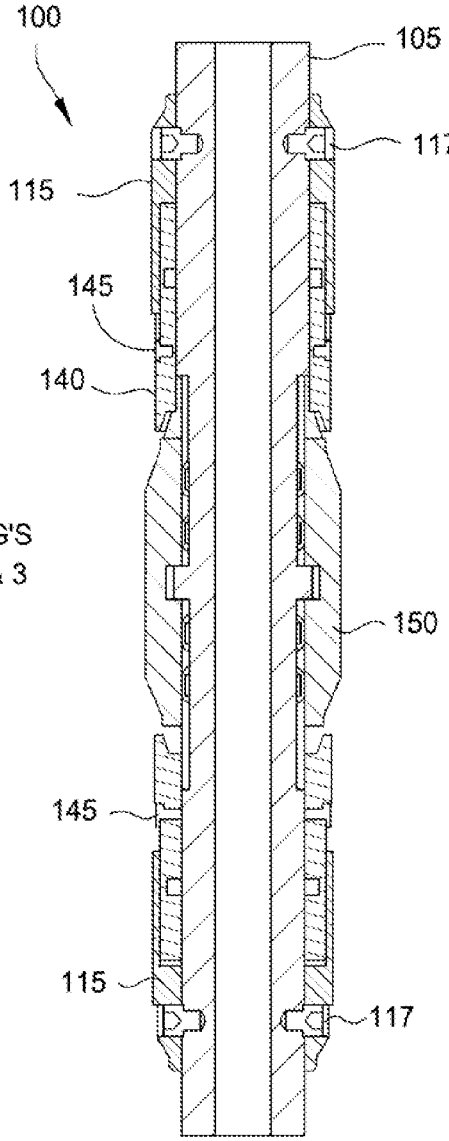
FIG. 2 illustrates a first sectional view of a cutting assembly of the wellbore tool according to one embodiment.
Figure 3:
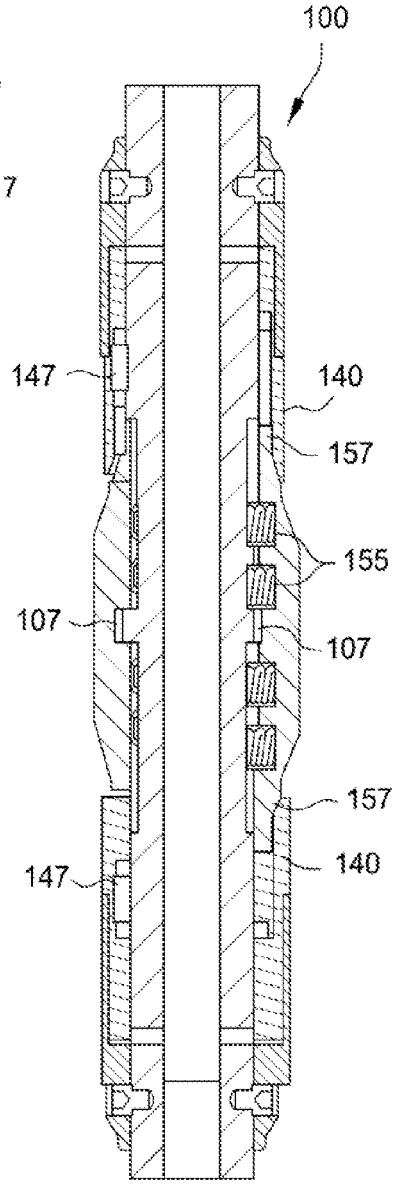
FIG. 3 illustrates a second sectional view of the cutting assembly of the wellbore tool according to one embodiment.

FIGS. 2 and 3 illustrate sectional views of the cutting assembly 100 on different planes, respectively, according to one embodiment. The cutting assembly 100 includes a mandrel 105 coupled at opposite ends to the top sub 110 and the intermediate sub 120. Upper and lower housings 115 are secured to the outer surface of the mandrel 105 by set screws 117 for stabilizing the tool 10. The outer diameters of the housings 115 may be about equal to the drift inner diameter of any wellbore tubular to centralize the cutting assembly 100 and to prevent or minimize vibrations during operation.

The housings 115 may support upper and lower pistons 140 that are operable to retract one or more cutting members, referred to herein as blades 150. The pistons 140 may be secured to the housings 115 and/or mandrel 105 using releasable members 145, such as shear pins, to prevent inadvertent actuation of the pistons 140. The pistons 140 may be disposed external to the mandrel 105, and/or may be movable relative to and/or along the outer surface of the mandrel 105. The blades 150 may be located on the mandrel 105 using a ring or protrusion 107 that is integral with or coupled to the mandrel 105, and that engages a groove on the rear surface of the blades 150 to prevent longitudinal movement of the blades 150. One or more biasing members 155, such as springs, are disposed between the mandrel 105 and the blades 150 for biasing the blades 150 radially outward into an extended position. The pistons 140 transmit torque from the mandrel 105 to the blades 150 from both sides through one or more keys 147 and/or through one or more arms 157 of the blades 150. The keys 147 may transmit torque from the mandrel to the pistons 140. The keys 147 and/or the arms 157 may be disposed between the mandrel 105 and the pistons 140, and may be seated in one or more grooves or slots formed in the mandrel 105 and/or the pistons 140.

In one embodiment, the cutting assembly 100 includes three segmented blades 150 positioned about 120 degrees apart on the mandrel 105. Each blade 150 may include one or more rows of replaceable or fixed carbide inserts. The blades 150 provide one or more cutting edges on the tool 10 for milling burrs, and which cover 360 degrees about the inner surface of any wellbore tubular when the tool 10 is rotated.

Figure 4A:
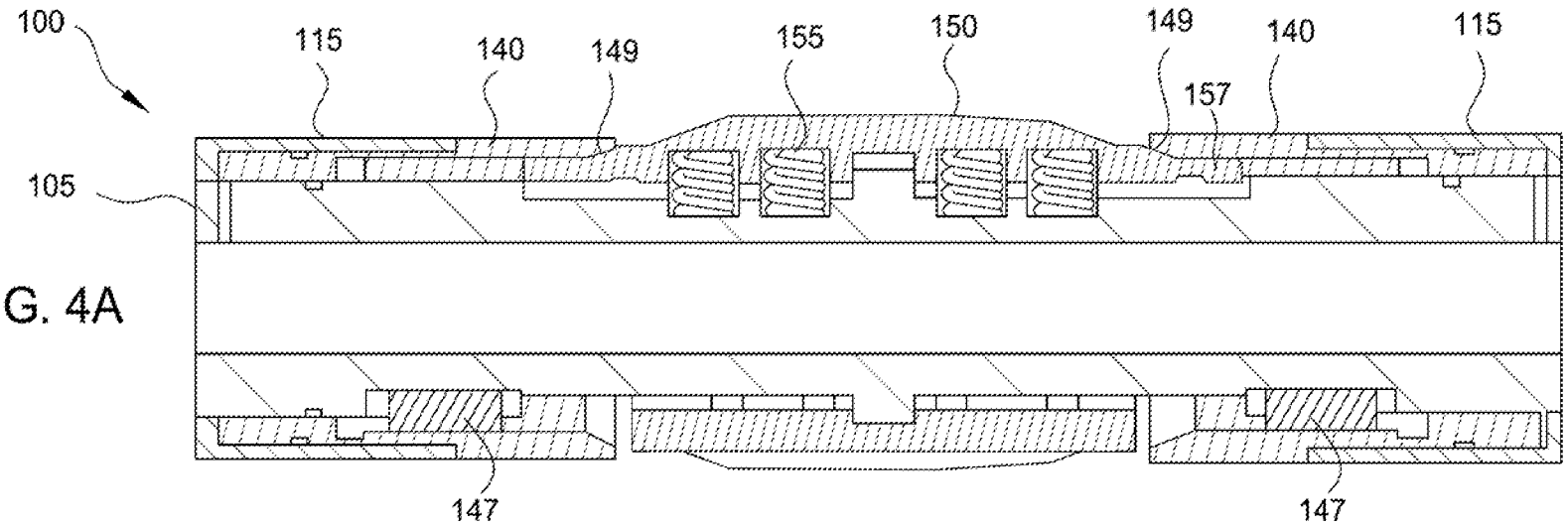
FIGS. 4A and 4B illustrate operational views of the cutting assembly according to one embodiment.

FIG. 4A illustrates the cutting assembly 100 in a run-in, extended position according to one embodiment. The blades 150 are fully extended by the biasing members 155 for contacting the inner surface of a wellbore tubular when the tool 10 is run-in. The blades 150 are supported by the biasing members 155 such that they do not wedge inside the wellbore tubular but exert enough outward (radial) contact force against the wellbore tubular for milling when the tool 10 is rotated. The tool 10 may be rotated while being run-in or may be lowered to a desired position and then rotated. Fluid may be circulated through the tool 10 during run-in and/or while being rotated to flush out any debris from the wellbore tubular and the well. The tool 10 may be rotated via a work string coupled to the top sub 110. As stated above, torque is transmitted from the mandrel 105 to the blades 105 via the pistons 140 and keys 147 and/or directly to the arms 157 of the blades 150.

Figure 4B:
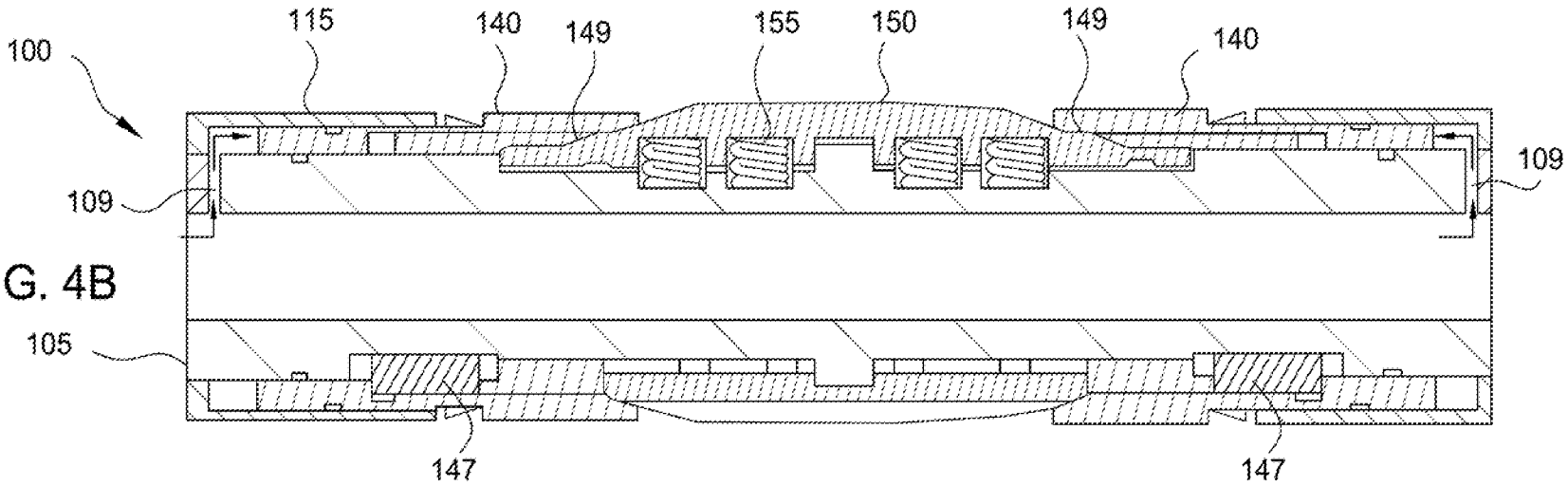

FIG. 4B illustrates the cutting assembly 100 in a retrieval, retracted position according to one embodiment. After completion of a milling or de-burring job, the blades 150 are retracted by actuation of the pistons 140. The ends of the blades 150 engage the pistons 140 at interface 149. In particular, tapered surfaces at the ends of the pistons 140 contact taper surfaces on the arms 157 of the blades 150 at interface 149. Pressurization of the tool 10 moves the pistons 140 longitudinally toward the blades 150 such that the tapered surfaces engage and force the blades 150 radially inward toward the mandrel 105 against the bias of the biasing members 155.

To pressurize the tool 10, a closure member, such as an extrudable ball or dart, may be dropped through the cutting assembly 100 and seat in the intermediate sub 120. Fluid flow out the end of the tool 10 is prevented to internally pressurize the cutting assembly 100. Pressurized fluid is communicated to the pistons 140 through one or more ports 109 in the mandrel 105. One or more seals, such as o-rings, may be used to seal fluid flow through the tool 10 and to the pistons 140 as known in the art. When the axial force on the pistons 140 due to the difference of internal and external pressures reaches a predetermined value, the releasable members 145 may be sheared to release the pistons 140 for axial movement. The pistons 140 may then move axially with enough force to retract the blades 150 by the tapered surface engagement at interface 149 simultaneously from top and bottom.

Figure 5B:
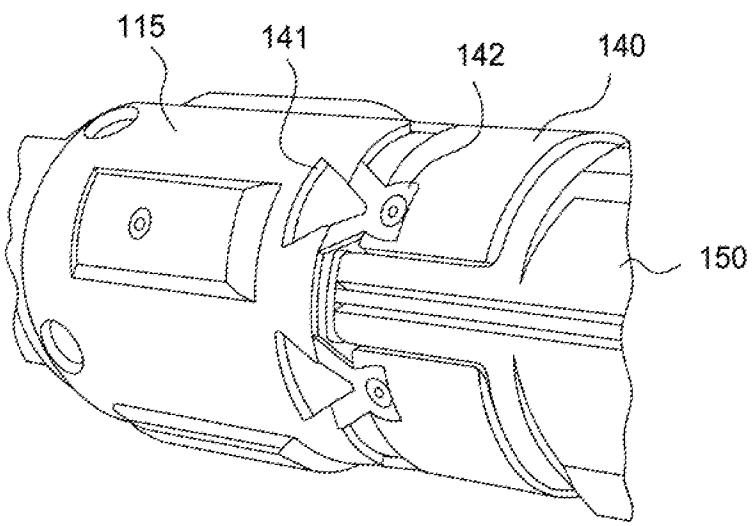
FIGS. 5A and 5B illustrate operational views of the cutting assembly according to one embodiment.
Figure 5A:
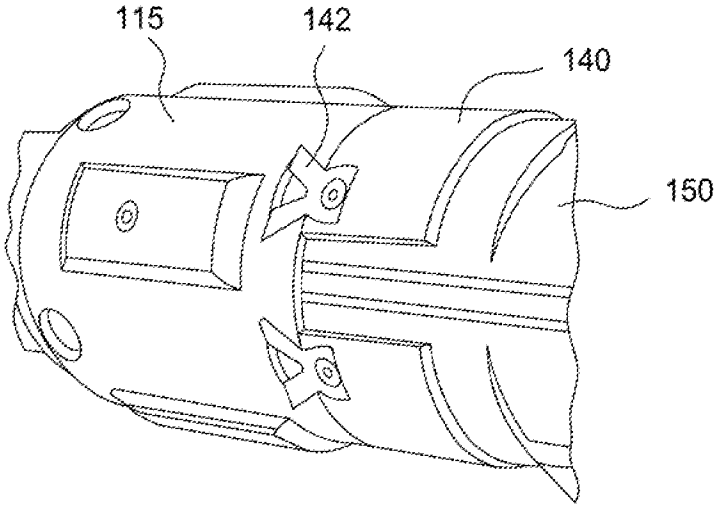

FIGS. 5A and 5B illustrate the blades 150 extended and retracted, respectively, according to one embodiment. FIG. 5A illustrates one of the pistons 140 prior to actuation in a first position. Referring to FIG. 5B, after the piston 140 has moved a predetermined distance or stroke to a second position, one or more locking elements 142 coupled to the piston 140 are moved out of one or more (dovetail shaped) grooves 141 on the housing 115. The locking elements 142 may include flexible portions that can deflect radially inward when being moved out of the grooves 141. The grooves 141 may be formed at an end of the housing 115 and spaced around the circumference. Although referred to herein as grooves 141, the grooves 141 may be recesses, slots, and/or other types of openings formed in the housing 115 for housing the locking elements 142 in one position. One or more deflectable portions of the locking elements 142 may extend radially outward and engage the housing 115 when removed from the grooves 141 to prevent the piston 140 from moving back into the housing 115, such as by gravity or vibration forces. After the internal pressure in the tool 10 is released, the blades 150 are thereby maintained in the retracted position. This locking feature permits continued operation of other tools on the same work string without any potential for damage to the wellbore tubular from the blades 150. For example, the closure member may be extruded through the intermediate sub 120 using pressurized fluid to open fluid flow through the tool 10 for conducting other operations.

Figure 7:
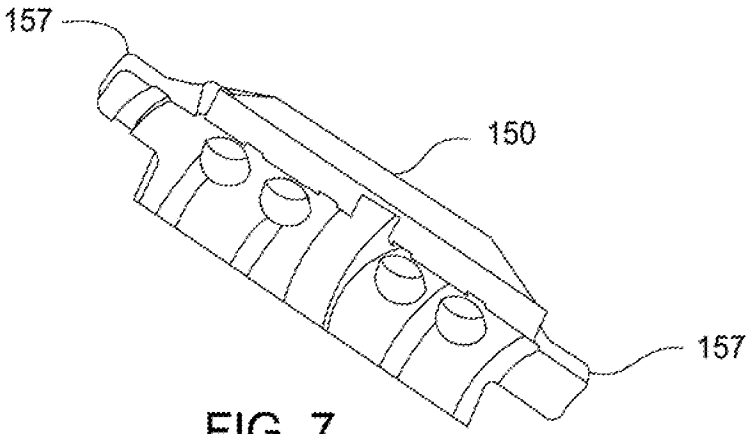
FIG. 7 illustrates a blade of the cutting assembly according to one embodiment.
Figure 6:
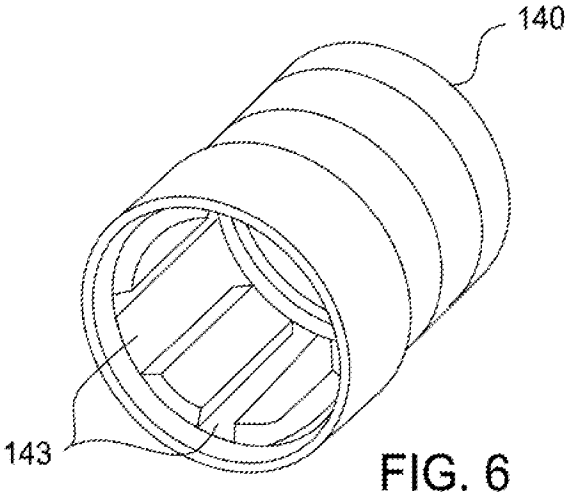
FIG. 6 illustrates a piston of the cutting assembly according to one embodiment.

FIGS. 6 and 7 illustrate a piston 140 and a blade 150, respectively, according to one embodiment. One or more grooves 143 are disposed along the inner diameter of the piston 140 for receiving the keys 147 and/or the arms 157 of the blades 150 for transmitting torque from the mandrel 105 to the blades 150. The one or more grooves 143 also permit longitudinal movement of the piston 140 relative to the keys 147 and/or the arms 157 of the blades 150. Each blade 150 may include one arm 157 at opposite ends, the arms 157 being integral with or coupled to the blades 150. To prevent packing of spaces between the blades 150, the longitudinal edges of the blades 150 may be chamfered, and one or more helical grooves may be formed on the outer diameter of the blades 150 so that debris can be flushed out easily. One or more holes may also be formed on the inner diameter of the blades 150 and/or the outer diameter of the mandrel 105 for supporting and preventing longitudinal movement of the biasing members 155.

Figure 8:
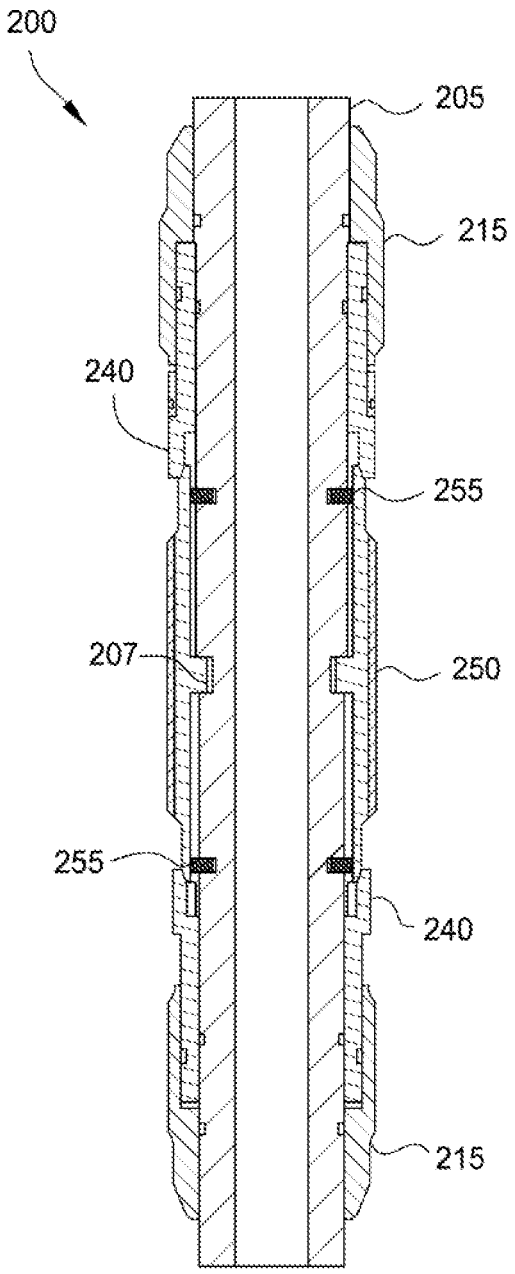
FIG. 8 illustrates a first sectional view of the cutting assembly of the wellbore tool according to one embodiment.
Figure 9:
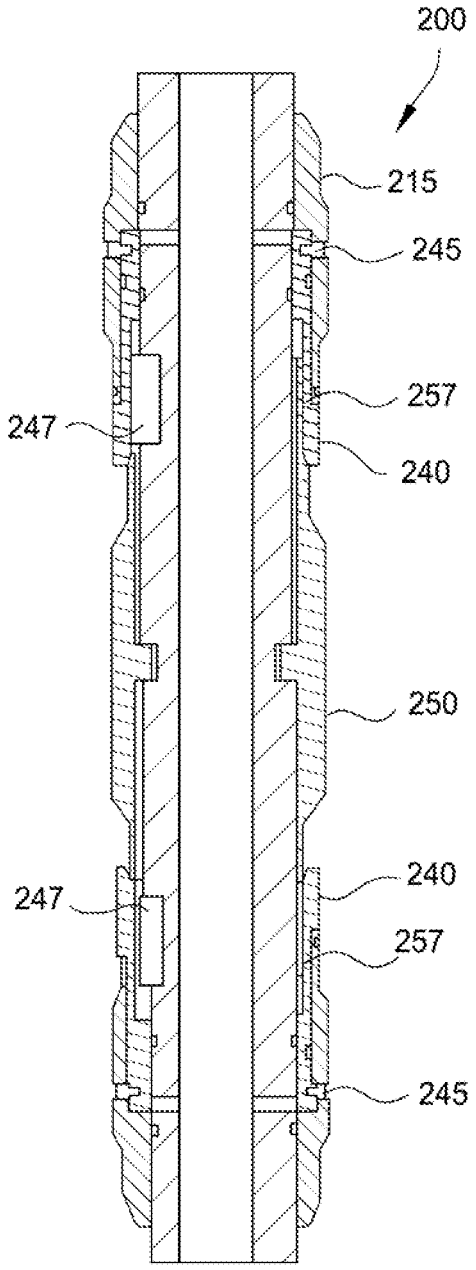
FIG. 9 illustrates a second sectional view of the cutting assembly of the wellbore tool according to one embodiment.

FIGS. 8 and 9 illustrate sectional views of a cutting assembly 200 on different planes, respectively, according to one embodiment. The cutting assembly 200 may be used with the embodiments of the tool 10 described above. The components of the cutting assembly 200 that are substantially similar to the components of the cutting assembly 100 are identified with "200" series reference numbers and full descriptions of such components will not be repeated for brevity.

As illustrated, the pistons 240 are releasably coupled to the housings 215 via one or more releasable members 245 to prevent premature actuation of the pistons 240 and retraction of the blades 250. The blades 250 may be located on the mandrel 205 using one or more rings or protrusions 207. The rings or protrusions 207 may be integral with or coupled to the blades 250, and may engage a groove or slot on the outer surface of the mandrel 205 to prevent longitudinal movement of the blades 250 and/or for transmitting torque to the blades 250. Torque may be transmitted from the mandrel 205 to the blades 250 via the pistons 240 and keys 247 and/or directly to the arms 257 of the blades 250.

Figure 10A:
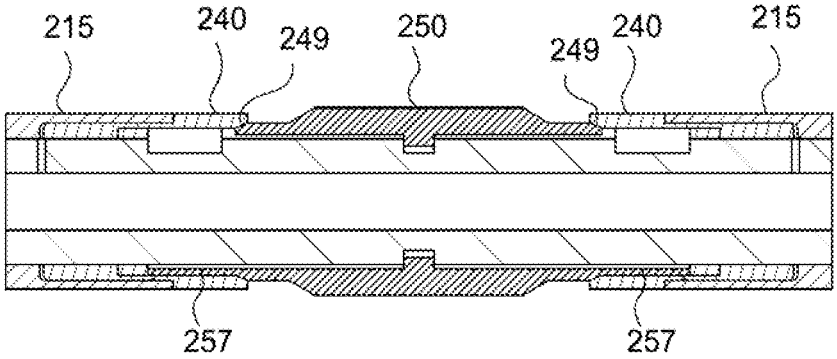
FIGS. 10A and 10B illustrate operational views of the cutting assembly according to one embodiment.

FIG. 10A illustrates the cutting assembly 200 in a run-in, extended position according to one embodiment. The blades 250 are fully extended by the biasing members 255. The tool 10 may be rotated via a work string coupled to the top sub 110, which is coupled to the mandrel 205.

Figure 10B:
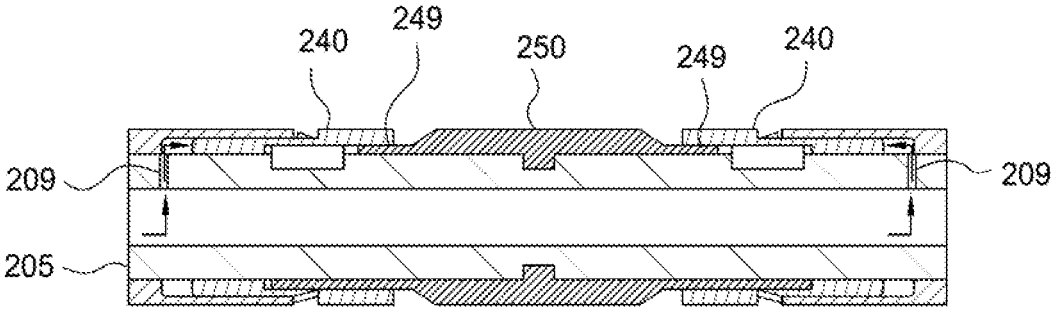

FIG. 10B illustrates the cutting assembly 200 in a retrieval, retracted position according to one embodiment. The blades 250 are retracted by actuation of the pistons 240. Tapered surfaces at the ends of the pistons 240 contact taper surfaces on the blades 250 at interface 249. After dropping a closure member to close fluid flow through the end of the tool 10, pressurized fluid is applied to the pistons 240 through one or more ports 209 in the mandrel 205 with enough force to shear the releasable members 245. One or more seals, such as o-rings, may be used to seal fluid flow through the tool 10 and to the pistons 240 as known in the art. The pistons 240 are then moved longitudinally toward the blades 250 such that the tapered surfaces at interface 249 engage and force the blades 250 radially inward toward the mandrel 205 against the bias of the biasing members 255. The pistons 240 may be locked from movement in the opposite direction using the locking feature described above with respect to FIGS. 5A and 5B.

Figure 12:
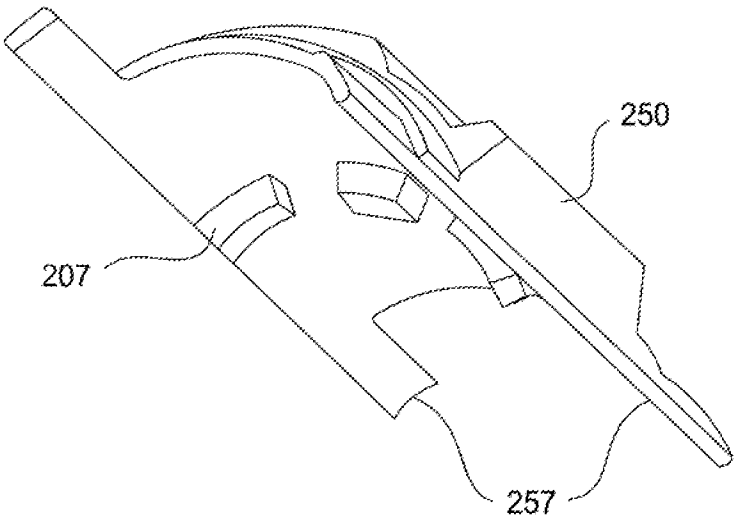
FIG. 12 illustrates the blade of the cutting assembly according to one embodiment.
Figure 11:
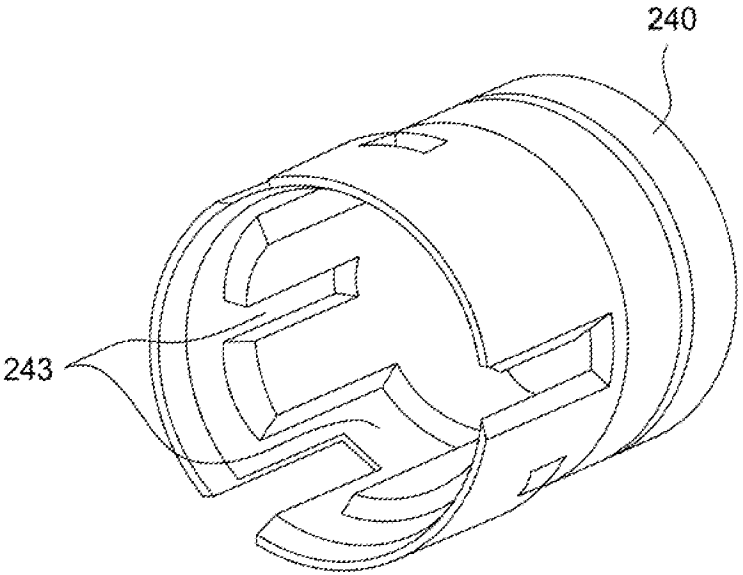
FIG. 11 illustrates the piston of the cutting assembly according to one embodiment.

FIGS. 11 and 12 illustrate a piston 240 and a blade 250, respectively, according to one embodiment. One or more grooves 243 are disposed along the inner diameter of the piston 240 for receiving the keys 247 and/or the arms 257 of the blades 250 for transmitting torque from the mandrel 205 to the blades 250. Each blade 250 may include two arms 257 at opposite ends, the arms 257 being integral with or coupled to the blades 250. To prevent packing of spaces between the blades 250, one or more windows may be formed in the pistons 240 so that debris can be flushed out easily.

Figure 13:
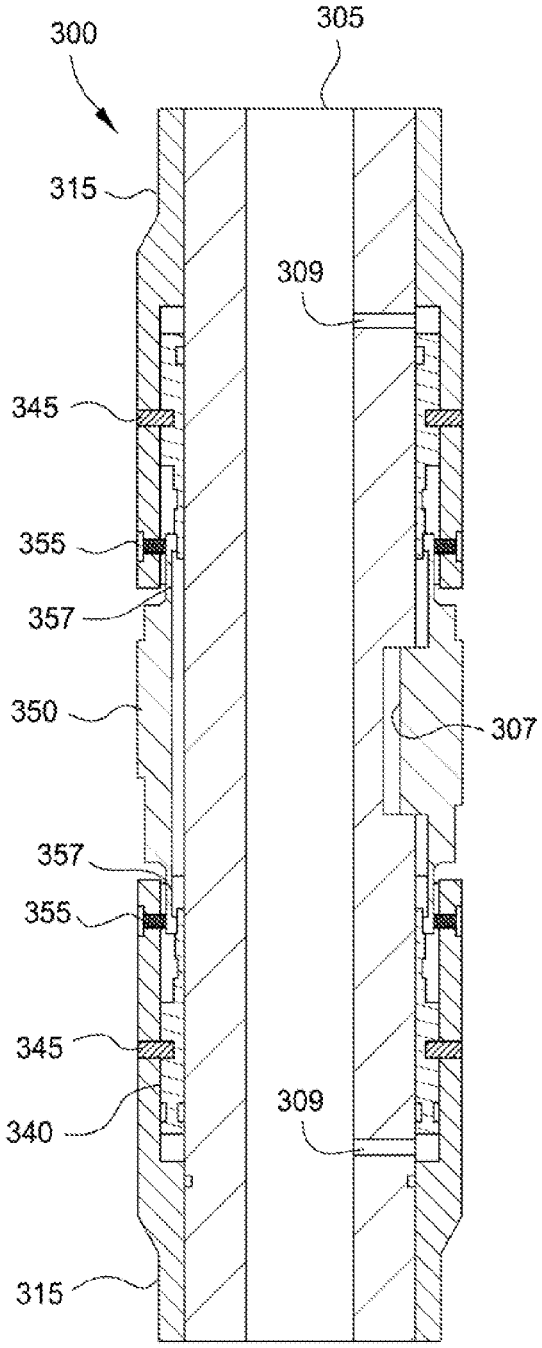
FIG. 13 illustrates a first sectional view of the cutting assembly of the wellbore tool according to one embodiment.
Figure 14:
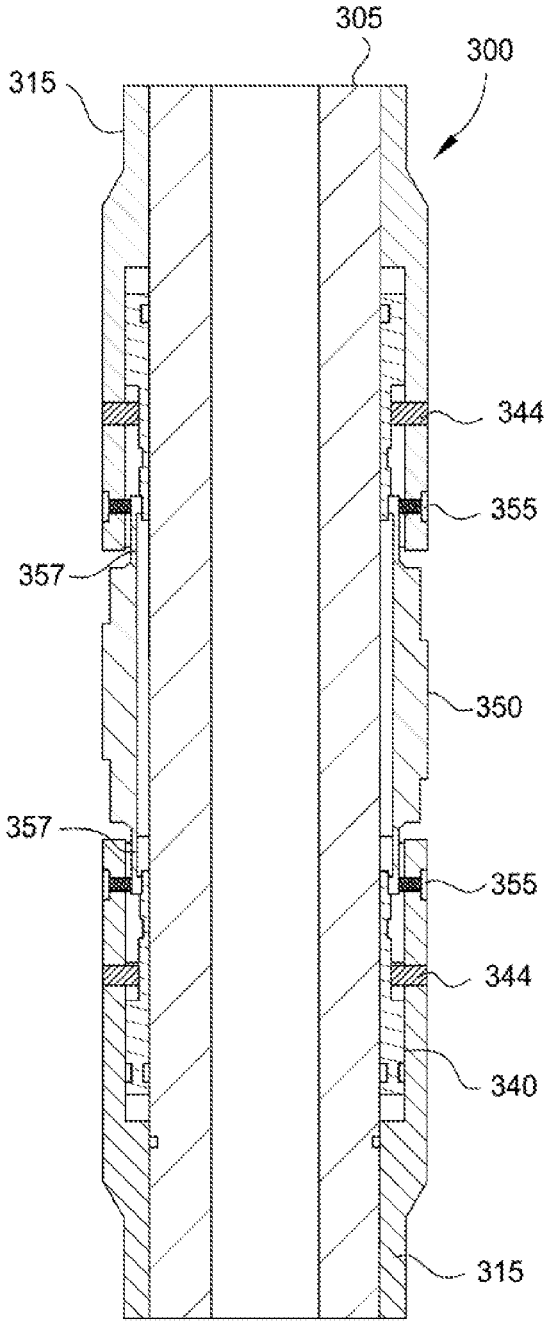
FIG. 14 illustrates a second sectional view of the cutting assembly of the wellbore tool according to one embodiment.

FIGS. 13 and 14 illustrate sectional views of a cutting assembly 300 on different planes, respectively, according to one embodiment. The cutting assembly 300 may be used with the embodiments of the tool 10 described above. The components of the cutting assembly 300 that are substantially similar to the components of the cutting assembly 100 are identified with "300" series reference numbers and full descriptions of such components will not be repeated for brevity.

The cutting assembly 300 is initially run-in with the blades 350 retracted, then actuated to move the blades 350 radially outward into an extended position, and then actuated again to move the blades 350 radially inward into a retracted position. The blades 350 are retracted in the run-in position. The biasing members 355 are positioned between the housings 315 and the blades 350 to bias the blades 350 radially inward toward the mandrel 305 into the retracted position. The pistons 340 are releasably coupled to the housings 315 via one or more first releasable members 345 to prevent premature actuation of the pistons 340 and outward actuation of the blades 350 into the extended position. The pistons 340 are temporarily prevented from movement toward the blades 350 by one or more second releasable members 344, after the first releasable members 345 are sheared, to prevent premature actuation of the pistons 340 and retraction of the blades 350 into the retracted position.

The blades 350 may be located on the mandrel 305 using one or more rings or protrusions 307. The rings or protrusions 307 may be integral with or coupled to the blades 350, and may engage a groove or slot on the outer surface of the mandrel 305 to prevent longitudinal movement of the blades 350. Torque may be transmitted from the mandrel 305 to the blades 350 via the rings or protrusions 307.

Figure 15A:
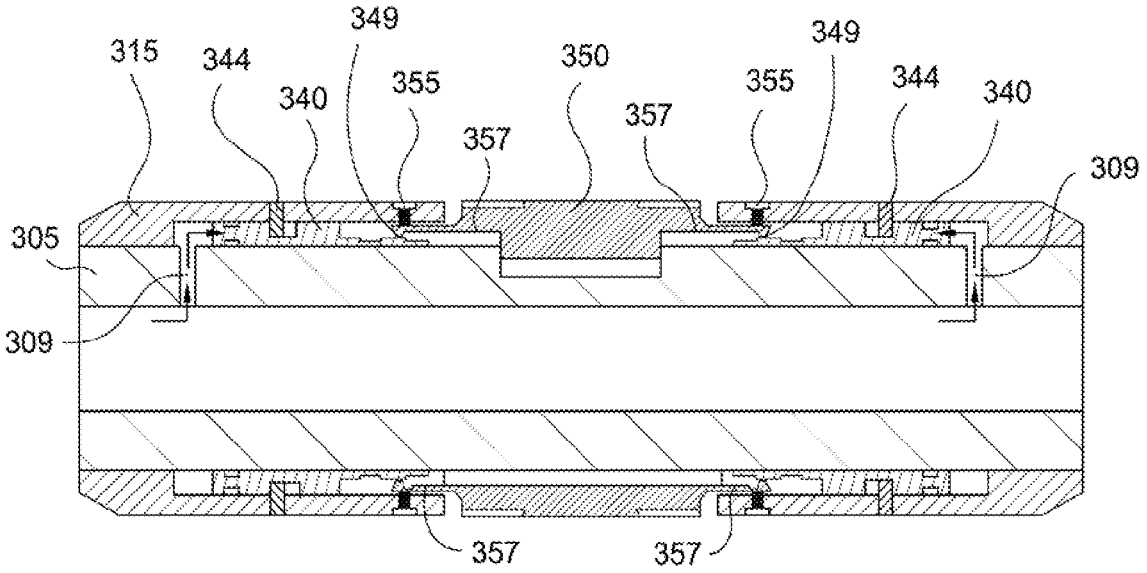
FIGS. 15A and 15B illustrate operational views of the cutting assembly according to one embodiment.

FIG. 15A illustrates the cutting assembly 300 in an actuated, extended position according to one embodiment. As illustrated, tapered surfaces at the ends of the pistons 340 contact taper surfaces on the arms 357 of the blades 350 at interface 349. After dropping a first closure member, such as an extrudable ball or dart, to close fluid flow through the end of the tool 10, pressurized fluid is applied to the pistons 340 through one or more ports 309 in the mandrel 305 with enough force to shear the first releasable members 345 (but not the second releasable members 344). One or more seals, such as o-rings, may be used to seal fluid flow through the tool 10 and to the pistons 340 as known in the art. The pistons 340 are then moved longitudinally toward the blades 350 such that the tapered surfaces at interface 349 engage and force the blades 350 radially outward away from the mandrel 305 and against the bias of the biasing members 355.

The travel of the pistons 340 is limited by contacting the second releasable members 344. When the pistons 340 contact the second releasable members 344 and are temporarily prevented from further movement, the tapered surfaces between the pistons 340 and the blades 350 are engaged such that the blades 350 are forced radially outward into contact with the wellbore tubular. Pressurized fluid may be used to extrude the first closure member and reestablish fluid circulation through the tool 10. The tool 10 may be rotated via a work string coupled to the top sub 110, which is coupled to the mandrel 305 for conducting a milling operation.

Figure 15B:
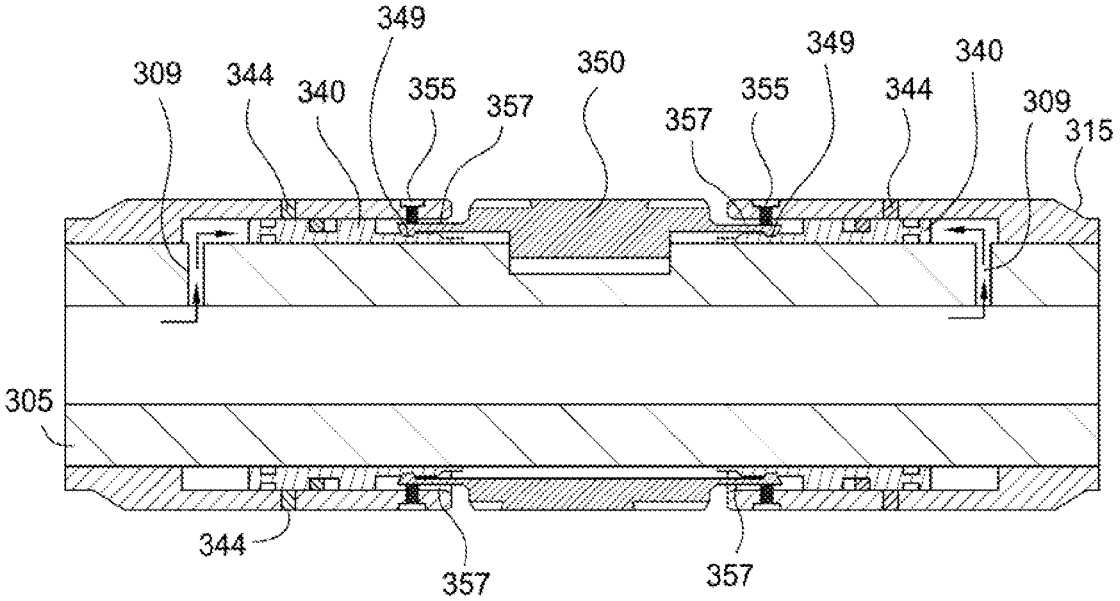

FIG. 15B illustrates the cutting assembly 300 in a retracted position according to one embodiment. The blades 350 are retracted by further actuation of the pistons 340. After dropping a second closure member, such as an extrudable ball or dart, to close fluid flow through the end of the tool 10, pressurized fluid is applied to the pistons 340 through one or more ports 309 in the mandrel 305 with enough force to shear the second releasable members 344. The pistons 340 then continue to move longitudinally toward the blades 350 such that the tapered surfaces on the arms 357 of the blades 350 drop into a groove or slot on the outer diameter of the piston 340. The biasing members 355 assist in forcing the blades 350 radially inward toward the mandrel 305. The pistons 340 may be locked from movement in the opposite direction by engagement with the arms 357 of the blades 350, and/or by using the locking feature described above with respect to FIGS. 5A and 5B.

Figure 16:
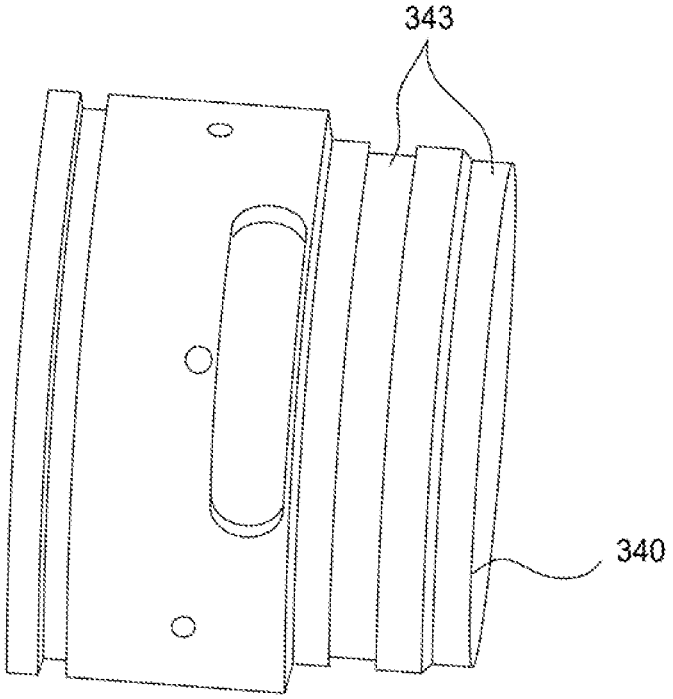
FIG. 16 illustrates the piston of the cutting assembly according to one embodiment.
Figure 17:
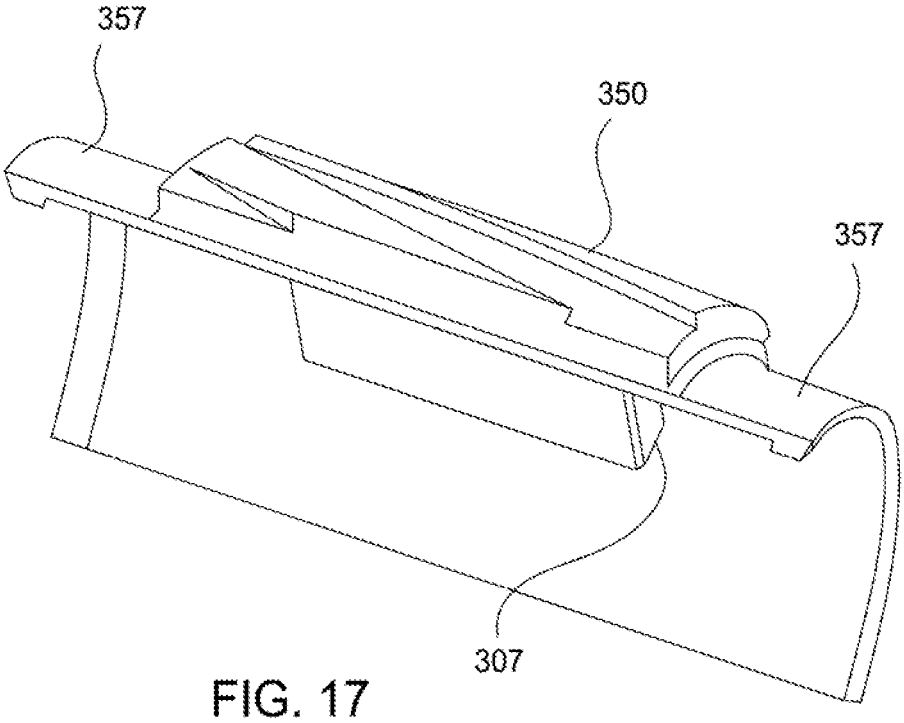
FIG. 17 illustrates the blade of the cutting assembly according to one embodiment.

FIGS. 16 and 17 illustrate a piston 340 and a blade 350, respectively, according to one embodiment. One or more grooves 343 are disposed along the outer diameter of the piston 340 for engagement with the arms 357 of the blades 350 for actuation and retraction. Each blade 350 may include arms 357 at opposite ends, the arms 357 being integral with or coupled to the blades 350. Torque may be transmitted from the mandrel 305 to the blades 350 via the rings or protrusions 307.

Figure 18A:
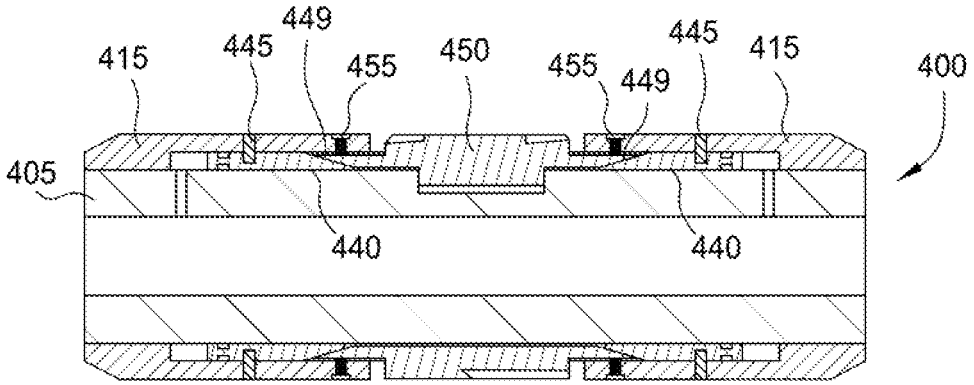
FIGS. 18A and 18B illustrate operational views of the cutting assembly according to one embodiment.
Figure 18B:
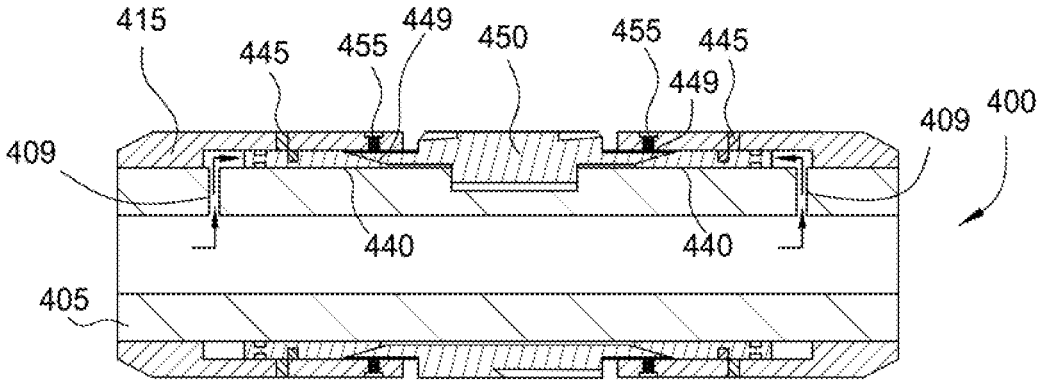

FIGS. 18A and 18B illustrate sectional views of a cutting assembly 400 in a retracted position and an extended position, respectively, according to one embodiment. The cutting assembly 400 may be used with the embodiments of the tool 10 described above. The components of the cutting assembly 400 that are substantially similar to the components of the cutting assembly 100 are identified with "400" series reference numbers and full descriptions of such components will not be repeated for brevity.

As illustrated in FIG. 18A, the blades 450 are retracted in the run-in position. The biasing members 455 are positioned between the housings 415 and the blades 450 to bias the blades 450 radially inward toward the mandrel 405 into the retracted position. The pistons 440 are releasably coupled to the housings 415 via one or more releasable members 445 to prevent premature actuation of the pistons 440 and outward actuation of the blades 450.

As illustrated in FIG. 18B, tapered surfaces at the ends of the pistons 440 contact taper surfaces on the arms 457 of the blades 450 at interface 449. After dropping a closure member, such as an extrudable ball or dart, to close fluid flow through the end of the tool 10, pressurized fluid is applied to the pistons 440 through one or more ports 409 in the mandrel 405 with enough force to shear the releasable members 445. One or more seals, such as o-rings, may be used to seal fluid flow through the tool 10 and to the pistons 440 as known in the art. The pistons 440 are then moved longitudinally toward the blades 450 such that the tapered surfaces at interface 349 engage and force the blades 450 radially outward away from the mandrel 405 against the bias of the biasing members 455 into the extended position for contact with the surrounding wellbore tubular.

The travel of the pistons 440 is limited by the blades 450 contacting the surrounding wellbore tubular. Torque may be transmitted from the mandrel 405 to the blades 450 via the rings or protrusions 407 that are integral with or coupled to the blades 450. The tool 10 may be rotated via a work string coupled to the top sub 110, which is coupled to the mandrel 405 for conducting a milling operation. After the milling operation is complete, fluid pressure in the tool 10 may be released, and the blades 450 may be retracted by the force of the biasing members 455. The force of the biasing members 455 on the blades 450 also move the pistons 440 back in the opposite direction into the retracted position for subsequent operation of the tool 10 and/or other wellbore operations.

Figure 19:
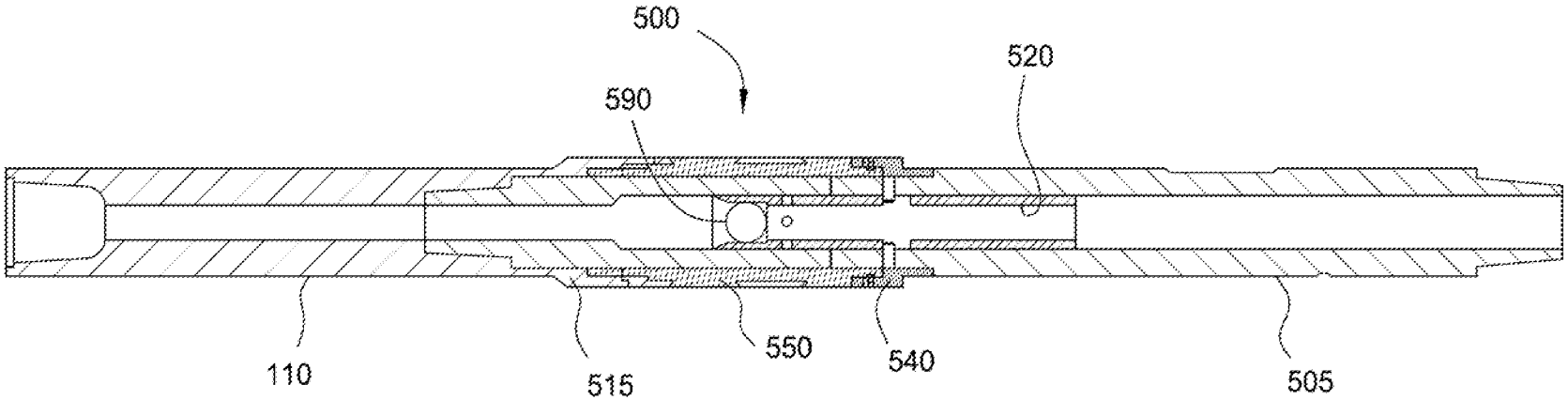
FIG. 19 illustrates a sectional view of the cutting assembly of the wellbore tool according to one embodiment.

FIG. 19 illustrates a sectional view of a cutting assembly 500 according to one embodiment. The cutting assembly 500 may be used with the embodiments of the tool 10 described above. The components of the cutting assembly 500 that are substantially similar to the components of the cutting assembly 100 are identified with "500" series reference numbers and full descriptions of such components will not be repeated for brevity.

As illustrated, the top sub 110 may be coupled to housing 515 and mandrel 505. The top sub 110 and the housing 515 may be integral with each other and formed as a unitary sub. The top sub 110 and/or housing 515 may engage and transmit torque to the blades 550. An inner sleeve 520 may be disposed internal to the mandrel 505, in the flow bore of the mandrel 505 for receiving a closure member 590, such as an extrudable ball or dart. The inner sleeve 520 may be connected to an outer sleeve 540, disposed external to the mandrel 505, by one or more keys 597. The keys 597 may be axially movable within one or more slots 509 of the mandrel 505 and may axially couple the inner sleeve 520 to the outer sleeve 540. The keys 597, however, may permit rotation of the inner sleeve 520 and the mandrel 505 relative to the outer sleeve 540. The outer sleeve 540 may be coupled to the blades 550 via one or more set screws 517.

Figure 20A:
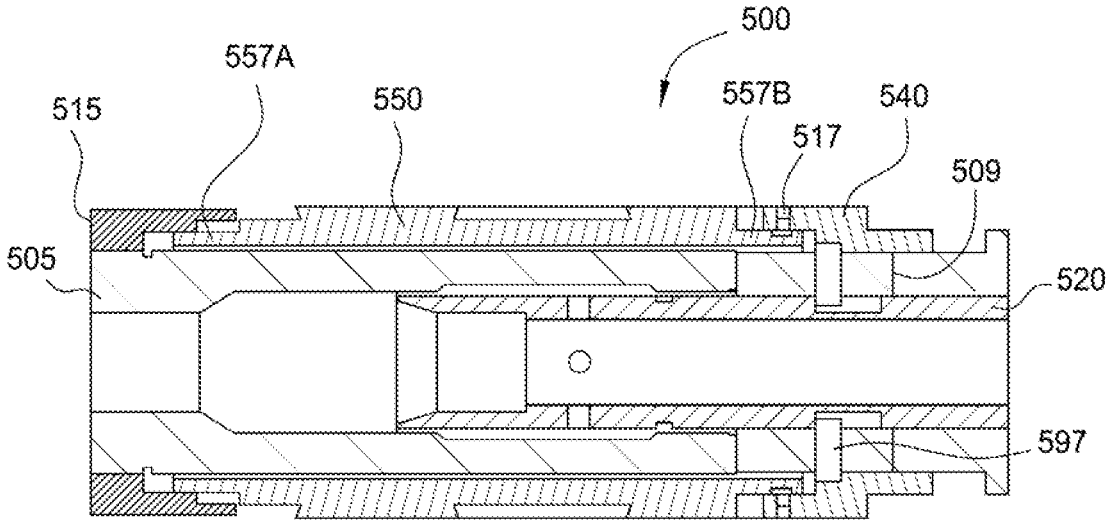
FIGS. 20A and 20B illustrate operational views of the cutting assembly according to one embodiment.

FIG. 20A illustrates the cutting assembly 500 in a run-in, activated position according to one embodiment. As illustrated, the blades 550 may be fully extended outward and ready for conducting a milling operation by rotation of a work string supporting the tool 10. Rotation of the top sub 110 via the work string rotates the housing 515, which rotates the blades 550. Upon completion of the milling operation, closure member 590 may be dropped onto seat 595 of the inner sleeve 520 to close fluid flow through the end of the tool 10 and move the cutting assembly 500 to a deactivated position.

Figure 20B:
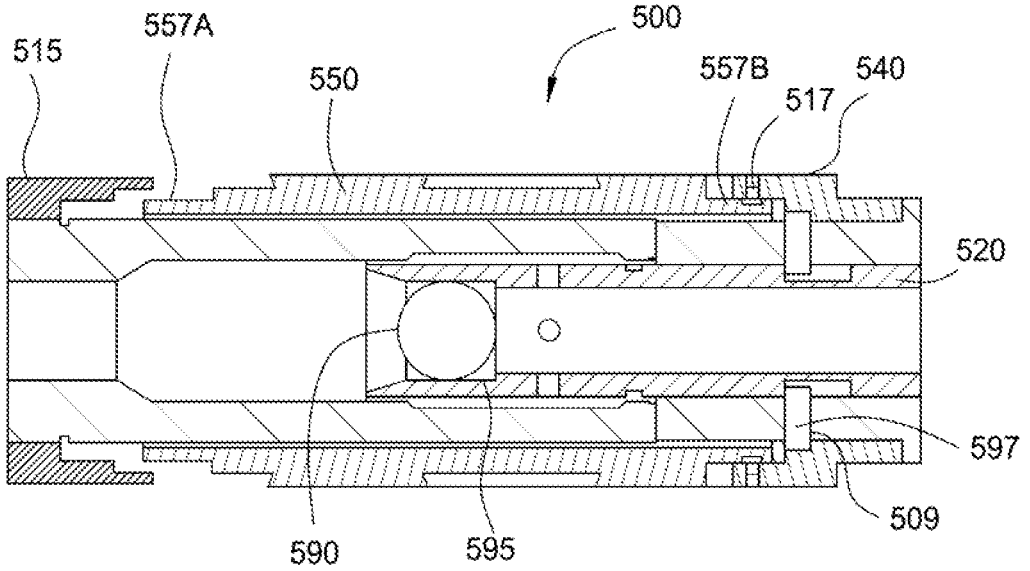

FIG. 20B illustrates the cutting assembly 500 in a deactivated position. Pressurized fluid is applied to the closure member 590 and the inner sleeve 520 with enough force to move the inner sleeve 520 in a downward direction, away from the top sub 110. One or more seals, such as o-rings, may be used to seal fluid flow through the tool 10 and the inner sleeve 520 as known in the art. The axial force applied to the inner sleeve 520 pushes or forces the outer sleeve 540 away from the top sub 110 via the key 597 connection. The outer sleeve 540 pulls or forces the blades 550 away from the top sub 110 via the set screw 517 connection, which moves the blades 550 out of engagement with the housing 515. Travel of the outer sleeve 540 may be limited by the key 597 contacting the end of the slot 509 in the mandrel 505. Fluid circulation may be reestablished by extruding the closure member 590 through the seat 595, and/or flowing fluid around the closure member 590 and through one or more ports in the inner sleeve 520 for flow out the end of the tool 10.

The blades 550 are deactivated by being rotationally decoupled from the housing 515, the top sub 110, and the mandrel 505. Rotation of the top sub 110 rotates the housing 515 but not the blades 550, which are no longer engaged with the housing 515. Rotation of the top sub 110 rotates the mandrel 505, the inner sleeve 520, and the keys 597, but not the outer sleeve 540 or the blades 550 since the keys 590 move within a circumferential groove or slot in the outer sleeve 540. The outer sleeve 540 may be locked from movement in the opposite direction using the locking feature described above with respect to FIGS. 5A and 5B. In one embodiment, the torque transmission to the blades 550 may be provided by the inner and outer sleeves 520, 540 via keys 597; and the outer sleeve 540 may be moved out of engagement with the blades 550 (e.g. a spline engagement as opposed to set screws 517) by the closure member 590 and pressurized fluid operation described above to decouple torque transmission to the blades 550.

Figure 21:
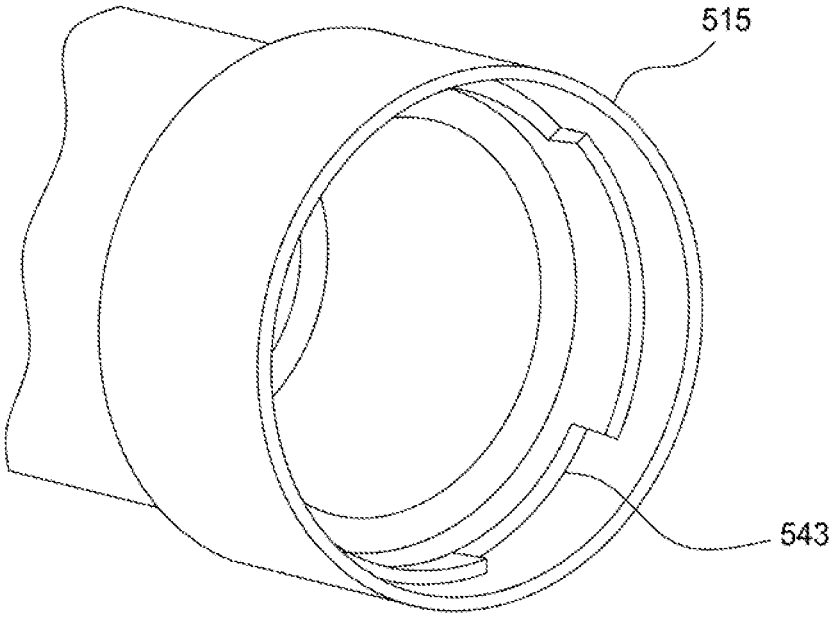
FIG. 21 illustrates a housing of the wellbore tool according to one embodiment.
Figure 22:
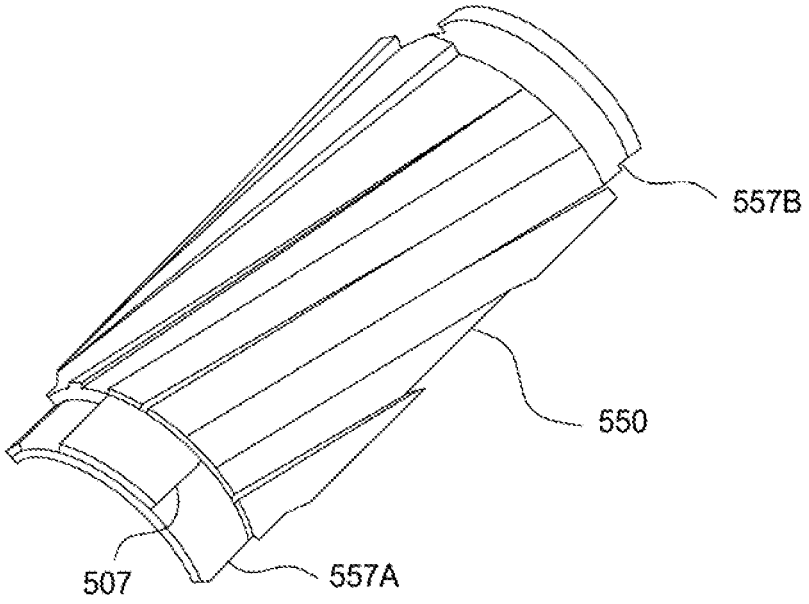
FIG. 22 illustrates the blade of the cutting assembly according to one embodiment.

FIGS. 21 and 22 illustrate the housing 515 and a blade 550, respectively, according to one embodiment. One or more grooves 543 are disposed along the inner diameter of the housing 515 for engagement with one or more rings or protrusions 507 that are coupled to or integral with the arm 557A of the blades 550 for torque transmission. Each blade 550 may include arm 557B at an opposite end having a shoulder for engagement with set screws 517 and connection to the outer sleeve 540.

The embodiments of the cutting assemblies 100, 200, 300, 400, and 500 described herein may be combined and/or interchanged (in whole or part) with each other to form one or more additional embodiments, all of which may be used with the tool 10. One or more of the components of the cutting assemblies 100, 200, 300, 400, and 500, and tool 10 may be formed from metallic and/or drillable materials as known in the art. One or more of the components of the cutting assemblies 100, 200, 300, 400, and 500, and tool 10 may be sealed using o-rings or other types of seals as known in the art. One or more of the components of the cutting assemblies 100, 200, 300, 400, and 500, and tool 10 may be formed integral with each other or coupled together using one or more connections as known in the art.

While the foregoing is directed to embodiments of the invention, other and further embodiments of the invention may be devised without departing from the basic scope thereof, and the scope thereof is determined by the claims that follow.

The invention claimed is:

1. A wellbore tool, comprising:
a top sub;
a cutting assembly comprising:
a mandrel in fluid communication with the top sub;
a piston disposed external to the mandrel, wherein the mandrel is disposed through the piston; and
a cutting member selectively movable into at least one of a retracted position and an extended position using the piston, wherein the mandrel is in engagement with the cutting member to prevent longitudinal movement of the cutting member;
a bottom sub operable to close fluid flow through the tool; and
a locking member to prevent movement of the piston in an opposite direction after the piston moves in a first direction to actuate the cutting member into at least one of the retracted position and the extended position.

2. The tool of claim 1, wherein the mandrel includes one or more ports to provide fluid communication between a flow bore of the mandrel and the piston.

3. The tool of claim 1, wherein the piston is coupled to the mandrel using one or more releasable members.

4. The tool of claim 1, wherein the piston includes a tapered surface movable into engagement with a tapered surface of the cutting member to move the cutting member into at least one of the retracted position and the extended position.

5. The tool of claim 1, further comprising one or more keys for transmitting torque from the mandrel to at least one of the piston and the cutting member.

6. The tool of claim 1, wherein the tool includes a seat for receiving an extrudable closure member for closing fluid flow through the tool.

7. The tool of claim 1, further comprising one or more biasing members for biasing the cutting member into at least one of the retracted position and the extended position.

8. A method of operating a wellbore tool, comprising:
lowering the tool into a tubular using a work string;
rotating a cutting assembly of the tool to remove irregularities from an inner surface of the tubular, wherein the cutting assembly comprises a mandrel, a piston, and a cutting member;
actuating the cutting member into at least one of a retracted position and an extended position using the piston while preventing longitudinal movement of the cutting member relative to the mandrel, wherein the piston is disposed external to the mandrel, and wherein the mandrel is disposed through the piston; and
using a locking member to prevent movement of the piston in an opposite direction after the piston moves in a first direction to actuate the cutting member into at least one of the retracted position and the extended position.

9. The method of claim 8, further comprising supplying pressurized fluid through one or more ports of the mandrel actuate the piston.

10. The method of claim 8, further comprising releasing one or more releasable members to move the piston relative to the mandrel and actuate the cutting member.

11. The method of claim 8, further comprising moving a tapered surface of the piston into engagement with a tapered surface of the cutting member to move the cutting member into at least one of the retracted position and the extended position.

12. The method of claim 8, further comprising transmitting torque from the mandrel to at least one of the piston and the cutting member using one or more keys.

13. The method of claim 8, further comprising flowing a closure member into engagement with a seat of the tool to close fluid flow through the tool.

14. The method of claim 13, further comprising extruding the closure member through the seat to open fluid flow through the tool.

15. The method of claim 8, further comprising biasing the cutting member into at least one of the retracted position and the extended position.

16. A wellbore tool, comprising:
a top sub; and
a cutting assembly comprising:
a mandrel in fluid communication with the top sub;
a sleeve coupled to the mandrel; and a cutting member rotationally coupled to the top sub when the sleeve is in a first position, wherein the cutting member is rotationally decoupled from the top sub and the mandrel is rotationally coupled with the top sub which rotates when the sleeve is in a second position.

17. The tool of claim 16, wherein the top sub is in engagement with the cutting member to transmit torque from the top sub to the cutting member.

18. The tool of claim 17, wherein the sleeve is disposed in a bore of the mandrel, and includes a seat for receiving a closure member to close fluid flow through the bore of the mandrel.

19. The tool of claim 18, further comprising an outer sleeve axially coupled to the sleeve by one or more keys, wherein the outer sleeve is coupled to the cutting member.

20. The tool of claim 19, wherein the cutting member is movable out of engagement with the top sub using the outer sleeve to rotationally decouple the cutting member from the top sub.

21. The tool of claim 20, wherein the sleeve is movable into the second position using pressurized fluid to move the outer sleeve via the one or more keys to move the cutting member out of engagement with the top sub.

22. A method of operating a wellbore tool, comprising:

lowering the tool into a tubular using a work string;

rotating a cutting assembly of the tool to remove irregularities from an inner surface of the tubular, wherein the cutting assembly comprises a mandrel, a sleeve, and a cutting member, and wherein the cutting member is rotationally coupled to the mandrel and the mandrel is rotationally coupled to the work string;

rotationally decoupling the cutting member from the mandrel using the sleeve while the mandrel remains rotationally coupled to the work string; and rotating the work string while the cutting member is rotationally decoupled from the mandrel.

23. The method of claim 22, wherein the tool includes a top sub for transmitting torque to the cutting member.

24. The method of claim 23, further comprising flowing a closure member onto a seat of the sleeve to close fluid flow through the bore of the mandrel.

25. The method of claim 24, wherein the cutting assembly further comprises an outer sleeve axially coupled to the sleeve by one or more keys, wherein the outer sleeve is coupled to the cutting member.

26. The method of claim 25, further comprising moving the cutting member out of engagement with the top sub using the outer sleeve to rotationally decouple the cutting member from the top sub.

27. The method of claim 26, further comprising moving the sleeve using pressurized fluid to move the outer sleeve via the one or more keys to move the cutting member out of engagement with the top sub.

28. A wellbore tool locking assembly, comprising:

a housing having a groove in an outside wall thereof;

a piston movable relative to the housing; and a locking element coupled to an outside surface of the piston, wherein the piston is movable in one direction from a first position where the locking element is disposed in the groove to a second position where the locking element is removed from the groove, and wherein the locking element prevents movement of the piston in an opposite direction when the locking element is removed from the groove.

29. The assembly of claim 28, wherein the locking element is a flexible member that deflects radially inward when being moved out of the groove.

30. The assembly of claim 29, wherein the flexible member extends radially outward when removed from the groove.

31. The assembly of claim 30, wherein the flexible member engages the housing when removed from the groove to prevent movement of the piston in the opposite direction.

32. The assembly of claim 31, wherein the groove is formed at an end of the housing.

33. The assembly of claim 32, wherein the groove is a dovetail shaped groove.

34. A wellbore tool, comprising:

a top sub;

a cutting assembly comprising:

a mandrel in fluid communication with the top sub;

a first piston and a second piston, wherein the mandrel is disposed through the first piston and second piston; and a cutting member selectively movable into at least one of a retracted position and an extended position by at least one of simultaneously engaging and disengaging with the first piston and the second piston, wherein the first piston moves in a first axial direction and engages one side of the cutting member, and the second piston moves in a second axial direction that is opposite the first axial direction and engages an opposite side of the cutting member; and a bottom sub operable to close fluid flow through the wellbore tool.

* * * * *